US005084433A

United States Patent [19]

Kraft

[11] Patent Number: 5,084,433

[45] Date of Patent: Jan. 28, 1992

[54] CARBONLESS PAPER PRINTABLE IN ELECTROPHOTOGRAPHIC COPIERS

[75] Inventor: Keith A. Kraft, Mendota Heights, Minn.

[73] Assignee: Minnesota Mining and Manufacturing Company, St. Paul, Minn.

[21] Appl. No.: 616,799

[22] Filed: Nov. 21, 1990

[51] Int. Cl.[5] ..... B41M 5/00; G03G 17/04

[52] U.S. Cl. ..... 503/201; 430/32; 503/213; 503/215

[58] Field of Search ..... 427/150–152; 503/213, 215, 225, 201; 430/32

[56] References Cited

U.S. PATENT DOCUMENTS

| | | | |
|---|---|---|---|
| 2,800,457 | 7/1957 | Green et al. | 252/316 |
| 2,800,458 | 7/1957 | Green | 252/316 |
| 3,429,827 | 2/1969 | Ruus | 252/316 |
| 3,516,846 | 6/1970 | Matson | 117/36.2 |
| 3,516,941 | 6/1970 | Matson | 252/316 |
| 4,012,554 | 3/1977 | Miller et al. | 428/327 |
| 4,027,065 | 5/1977 | Breckett et al. | 428/307 |
| 4,086,650 | 4/1978 | Davis et al. | 361/229 |
| 4,087,376 | 5/1978 | Foris et al. | 252/316 |
| 4,100,103 | 7/1978 | Foris et al. | 252/316 |
| 4,232,083 | 11/1980 | Buerkley et al. | 428/307 |
| 4,244,604 | 1/1981 | Fraser | 282/27.5 |
| 4,265,990 | 5/1981 | Stolka et al. | 430/59 |
| 4,278,342 | 7/1981 | Andrew et al. | 250/325 |
| 4,461,496 | 7/1984 | Ludwig | 346/210 |
| 4,564,282 | 1/1986 | Shemoy | 250/324 |
| 4,596,996 | 6/1986 | Sandberg et al. | 346/207 |
| 4,601,863 | 7/1986 | Shioi et al. | 264/4.3 |
| 4,696,856 | 9/1987 | Okada et al. | 428/321.5 |
| 4,699,658 | 10/1987 | Okada et al. | 106/21 |
| 4,879,269 | 11/1989 | Takahashi et al. | 503/213 |
| 4,906,605 | 3/1990 | Kraft | 503/215 |

FOREIGN PATENT DOCUMENTS

| | | |
|---|---|---|
| 950443 | 2/1964 | European Pat. Off. . |
| 1046409 | 10/1966 | European Pat. Off. . |
| 2006709 | 5/1979 | United Kingdom . |
| 2062570 | 5/1981 | United Kingdom . |

OTHER PUBLICATIONS

"The Physics and Technology of Xerographic Processes," Edgar M. Williams, John Wiley and Sons, New York, NY, pp. 71–72.

"Introducing the Xerox 5090 Duplicator," Xerox Corporation, Xerox Square 05A, Rochester, NY 14644.

"The 50 Series Copiers," Instant Printer, Circle Reader Service No. 167, pp. 84–86.

"Xerox Plans to Unveil a Line of Copiers in Effort to Build on Comeback in U.S.," Wall Street Journal, May 2, 1988, p. 9.

*Primary Examiner*—Bruce H. Hess

*Attorney, Agent, or Firm*—Gary L. Griswold; Walter N. Kirn; Mark A. Litman

[57] ABSTRACT

A carbonless paper construction for imaging via electrophotographic copiers comprising microcapsules encapsulating solvents of dialkyl esters of aliphatic dibasic organic acids, polyglycol ethers and alkyl ethers of monobasic aromatic acids.

44 Claims, No Drawings

CARBONLESS PAPER PRINTABLE IN ELECTROPHOTOGRAPHIC COPIERS

BACKGROUND OF THE INVENTION

1. Field of the Invention

This invention relates to encapsulation solvents for carbonless paper and in particular to carbonless paper having encapsulation solvents suitable for use in high speed electrophotographic printers and duplicators.

2. Description of the Related Art

Carbonless paper is widely used in the forms industry and carbonless paper forms have been printed in the past by conventional printing techniques such as offset printing, lithography, etc. With the advent of high speed electrophotographic copiers having dependable, high capacity collating systems and enhanced copy quality, there has been a movement to replace offset printing equipment located in print shops and large "quick-print" installations with electrophotographic copiers. For the successful use of carbonless papers in these copiers, compatibility of the carbonless paper with the machine is critical.

Carbonless papers are capable of producing an image upon application of pressure. They generally comprise at least two substrates (for example two sheets of paper) and involve coating one reactant, known as a color-former, on one substrate, and the other reactant, known as a developer, on another, mating, substrate. One surface, or side, of each substrate is coated with one of the two primary reactants. The two substrates are often referred to as a donor sheet and a receptor sheet. Means for preventing the reaction of the two reactants until activating pressure is applied are also provided. This is typically accomplished by encapsulation of one of the reactants. Preferably, the color-forming compound(s) in an appropriate hydrophobic solvent is encapsulated or contained in microcapsules and is coated on the back side of one sheet of paper to form a donor sheet. This donor sheet is then mated with a receptor sheet coated with a developer or reactant for the color-forming compound. The microcapsules serve the purpose of isolating the reactants from one another thus preventing reaction. Once activating pressure is applied to the untreated surface of the donor sheet, as from a stylus or business-machine key, the two substrates come into contact under sufficient pressure so that the capsules, corresponding to the pattern of applied pressure, rupture, and the solution of encapsulated color-former is released and transferred from the donor sheet to the receptor sheet. On the receptor sheet, a reaction between the previously separated reactants occurs. Since the color-former and the developer form a deeply colored image when reacted, an image forms on the receptor sheet corresponding to the path traveled by the stylus, or the pattern of pressure provided by the stylus or key. Herein the term, "activating pressure" includes, but is not limited to, pressure applied by hand with a stylus or pressure applied by a business machine key, for example a typewriter key; and the terms "encapsulation" and "encapsulated compounds" refer to microcapsules enclosing a color-former material therewithin.

A wide variety of processes exist by which microcapsules can be manufactured. These varied processes provide different techniques for producing capsules of varying sizes, alternative materials for the composition of the capsule shell, and various different functional materials within the shell. Some of these various processes are shown in U.S. Pat. Nos. 2,800,427; 2,800,458; 3,429,827; 3,516,846; 3,416,441; 4,087,376; 4,100,103; 4,909,605; and British Patent Spec. Nos. 1,046,409; and 950,443. A wide variety of capsule materials can be used in making the capsule shells, including gelatin and synthetic polymeric materials. A popular material for shell formation is the polymerization reaction between urea and formaldehyde, or melamine and formaldehyde, or the polycondensation products of monomeric or low molecular weight polymers of dimethylolurea or methylolated urea with aldehydes. A variety of capsule forming materials are disclosed, for example, in U.S. Pat. Nos. 2,800,458; 3,429,827; 3,156,846, 4,087,376; 4,100,103 and British Patent Spec. Nos. 1,046,409; 2,006,709 and 2,062,570.

A preferred construction comprises an encapsulated color-former dissolved in an appropriate hydrophobic solvent within microcapsules and coated with a suitable binder onto a back side of the donor sheet, sometimes referred to as a "coated back" (CB) sheet. A developer, also optionally in a suitable binder such as a starch or latex, is coated onto the front side of the receptor sheet sometimes referred to as a "coated front" (CF) sheet. The preparation of such a carbonless sheets is described by Matson in U.S. Pat. No. 3,516,846, incorporated herein by reference.

Constructions comprising a first substrate surface, on which is coated the encapsulated color-former, and, a second substrate surface, on which is coated a developer, are often prepared. The coated first substrate surface is positioned within the construction in contact with the coated second substrate surface. Such a construction is known as a "set" or a "form-set" construction.

Substrates, with one surface on which is coated the encapsulated color-former, and a second, opposite, surface on which is coated a developer can be placed between the CF and CB sheets, in a construction involving a plurality of substrates. Such sheets are generally referred to herein as "CFB" sheets (i.e., coated front and back sheets). Of course, each side including color-former thereon should be placed in juxtaposition with a sheet having developer thereon. CFB sheets are also typically used in form-sets. In some applications, multiple CFB sheets have been used in form-sets. These contain several intermediate sheets, each having a developer coating on one side and a coating with capsules of color-former on the opposite side.

Often carbonless paper is prepared and packaged in precollated form-sets in which sheets of various colors and surfaces are arranged opposite to their normal functional order. That is, the coated front sheet (CF) is first in the set and the coated back sheet (CB) is last with the required number of CFB sheets in between. This is done so that when the sheets are printed in a printer or copier which automatically reverses their sequence in the delivery tray, they will end up in the proper functional order for subsequent data entry. Sheets arranged in this manner are referred to as reverse sequence form-sets. In a second instance where reversal of the sequence in the delivery tray does not occur, the precollated sheets are arranged in their normal order. This arrangement is referred to as a straight sequence form-set. The type of sequenced form-set used for a particular printing operation is a function of the printing machinery.

The handling and transfer of the carbonless paper through the copier can lead to inadvertent rupture of capsules. Capsule rupture releases the encapsulation solvents from within the capsules, and results in exposure of the copier components to the solvent. Particularly sensitive copier components to solvent exposure are wires which serve the purpose of transferring electrical charges to photoconductor belts, copy paper or toner. The wires may be single wires or units commonly referred to as a corotron or a dicorotron. These wires are described in Davis et al., U.S. Pat. No. 4,086,650.

In the past, solvents used in the microcapsules of carbonless paper contained groups disposed toward breakdown in the atmosphere around a charging wire and contributed to unwanted residue build-up and contamination of the charging wire. Typically, contaminants build up on the charging wire and result in non-uniform current distribution across the charging wire. The non-uniform current distribution results in poor images being produced by the copy machine and/or machine difficulties.

Explanations for charging wire contamination is addressed by Williams. (see Edgar M. Williams, *The Physics and Technology of Xerographic Processes*, John Wiley and Sons). On page 71, Williams states "Normally, the atmosphere contains nitrogen, oxygen, oil vapors, Freon, salt crystals, dust, auto emissions, and a wide variety of elements and other chemicals. This air is ionized by the corona devices used in xerographic machines, so the possibility of interesting chemistry and crystal growth on and around corona wires is not surprising. Corona in air generates fair quantities of ozone so most commercial devices include activated charcoal filters to reduce ozone to acceptable levels. Ammonium nitrate salts can be created and precipitated by corona devices if the air contains ammonia at levels around 50 parts per billion. The salt crystallizes and grows on screen wires as well as on the PC surface. At high humidity, these salts become conductive and image quality is degraded because surface charge is transported laterally." The present invention addresses and minimizes the problems associated with contamination of the charging wires.

The chemistry used in carbonless papers is of two general types. In one type of carbonless paper, the image results from the reaction between an encapsulated leuco dye color-former and an acid developer. In another type of carbonless paper, the image results from the formation of a colored coordination compound by the reaction between an encapsulated ligand color-former a transition metal developer.

Leuco dye imaging chemistry employs capsules containing aliphatic hydrocarbon, or alkylated aromatic solvents. These solvents tend to have an odor, and upon inadvertent capsule rupture within a photocopier, a strong, objectionable, smell can result. Because copiers are often placed in areas with restricted ventilation, these odors can build up and cause discomfort to the machine operator.

Transition metal/ligand imaging chemistry usually involves capsules containing as the encapsulated ligand, derivatives of dithiooxamides (DTO), and as a developer, selected salts of nickel. Ligand/metal imaging systems have tended to use mixed solvents such as tributyl phosphate and diethyl phthalate. However, these solvents tend to decompose in the machine environment and contaminate the charging wires of the copier. This contamination eventually results in image deterioration and premature machine shutdown.

Both types of chemistry require solvents to dissolve the color-formers, and requirements for solvents for use in carbonless copy paper are stringent. For example, Okada et al., U.S. Pat. No. 4,699,658 give the requirements a solvent must fulfill.

1. It must dissolve the chromogenic dye precursor material at a high concentration.
2. It must not cause decomposition and color development of the chromogenic dye precursor.
3. It must have a high boiling point and not evaporate in the thermal drying step under high atmospheric temperature. (The requirement should be stated more broadly that the solvent must be stable to the encapsulation conditions.)
4. It must be insoluble in water.
5. It must show a high speed of color development and a high concentration of the developed color as well as high color stability after color developing.
6. It must be stable to light, heat, and chemicals.
7. The capsule fill should have a low viscosity so that it freely flows from the broken capsules.
8. It must be substantially odorless.
9. It must be safe and have a low toxicity.
10. It must be environmentally safe.

Okada et al. discuss solvent systems consisting of a mixture of biphenyls for use in a carbonless imaging system based upon a leuco dye color-former which is reacted with a phenolic resin developer. The advantages of Okada et al.'s solvents are that they permit rapid color development under low environmental temperatures and are taught to be substantially odorless.

One solution to the problems encountered in high speed copiers was achieved by Kraft and is disclosed in U.S. Pat. No. 4,906,605, incorporated herein by reference. Kraft found that the preparation of carbonless papers using high basis weight paper coupled with smaller capsule size and tighter capsule size distribution along with the elimination of stilt materials allows the successful use of these carbonless papers within copiers such as the Xerox 9000 series copiers and printers.

Many solvents have been used in carbonless paper constructions. For examples of some of the many solvents useful in carbonless imaging systems see Sandberg U.S. Pat. No. 4,596,996, column 2, lines 40–63. However, Sandberg does not distinguish among them with regard to particular usefulness, nor with the special requirements necessary for use in electrophotographic applications.

Brockett et al. U.S. Pat. No. 4,027,065 report that solvents for leuco dye systems which were both non-halogenated and non-aromatic had not yet found universal acceptance. They found that a high molecular weight ester, 2,2,4-trimethyl-1,3-pentanediol diisobutyrate, did not interfere significantly with color development and provided better fade resistance than solvents previously known.

Fraser U.S. Pat. No. 4,244,604 and Ludwig U.S. Pat. No. 4,461,496 teach the use of xylene, toluene, cyclohexane, phosphate esters, and phthalate esters as encapsulation solvents useful in carbonless papers employing ligand-metal imaging.

Miller, et al. U.S. Pat. No. 4,012,554 teach pressure rupturable microcapsules for use in a self contained paper. Their capsules contain all of the mark forming components in the same solution. Their imaging chemistry involves a leuco dye color-former reacting with an acidic developer such as a phenol. They disclose a solvent mixture containing a polar solvent which favors the uncolored form of the leuco dye. Upon imaging, evaporation of the polar component of the solvent mix results in a non-polar environment, favoring the colored form of the dye.

Recent improvements in solvents include the use of phenyl-sec-butylphenylmethane, as disclosed by Takashashi et al., U.S. Pat. No. 4,879,269. This system utilizes acid tripped leuco dye color-former chemistry for imaging.

A pigment such as carbon black and an adhesive dissolved in a solvent are disclosed by Okada et al. U.S. Pat. No. 4,696,856. The image is formed on a receptor sheet by transfer of the colored pigment, and the solvent is wicked away leaving the pigment in the adhesive. The solvent is used as a carrier for the adhesive and the pigment and there is no discussion of reactive chemistry used in an imaging process. They list solvents including xylene, toluene, ethylbenzene, mesitylene and other hydrocarbons. They also list hydrogenated aromatic hydrocarbons such as cyclohexane and esters such as diethyl phthalate, di-isopropyl phthalate, diethyl sebacate, diethyl adipate, ethyl benzoate, and the like.

To date, problems occurring with the electrophotographic copying of carbonless paper have not been adequately addressed. Charging wires becoming prematurely contaminated continues to hamper the use of carbonless paper in electrophotographic processes. It has now been discovered that the problems of residue build-up around charging wires which result in image deterioration and odors can be minimized through the use of specific solvents in the microcapsules.

SUMMARY OF THE INVENTION

In accordance with the invention, there is provided carbonless paper having microcapsules containing solvents and solvent mixtures, which when used to encapsulate color-formers and prepare carbonless copy-papers, render the carbonless copy-papers capable of use in electrophotographic copiers with a reduced level of undesirable side effects. These solvents comprise:

dialkyl esters of aliphatic dibasic organic acids, wherein the total number of carbon atoms in the ester is less than 17 and the parent alcohol contains from 1 to 4 carbon atoms and the parent dibasic acid contains from 4 to 10 carbon atoms;

polyglycol ethers such as those of the formula $$R_1O-(R_2-O)_n-R_3$$

wherein $R_1$ and $R_3$ are selected from the group consisting of phenyl, an alkyl substituted phenyl and an aliphatic hydrocarbon radical containing from 1 to 5 carbon atoms, $R_2$ is straight chain or branched alkyl group containing from 2–4 carbon atoms, and the total number of carbon atoms of $R_1$ and $R_3$ ranges from 4 and 10 and n ranges from 1–5; and esters of monobasic aromatic acids, the ester group being benzyl, substituted benzyl, and an alkyl group containing from 3 to 14 carbon atoms.

DETAILED DESCRIPTION OF THE INVENTION

It has been found that solvents containing polyglycol ethers, alkyl esters of aromatic acids, and dialkyl esters of aliphatic diacids function well as solvents in carbonless copy-paper constructions. These solvents provide high imaging speed, high density of ultimate image, are substantially odorless, are capable of encapsulating color-formers, and retain the other requirements for carbonless fill solvents used in electrophotographic copiers.

Simple ethers exhibit solubility problems as well as slow imaging speed with increasing molecular weight. For example, while dithiooxamide color-formers have a very fast image development speed combined with good ultimate density, they have only fair solubility in dibutyl ether. Hexyl ether shows reduced solubility for the dithiooxamide and a much slower imaging speed. When one switches to polyglycol ethers, an improvement in solvent properties is seen. Diethylene glycol diethyl ether (ethyl diglyme) represents the first member of the group of polyglycol ethers containing 3 oxygen atoms and affords excellent solubility for dithiooxamide color-formers, excellent image speed, and good ultimate density. However, it is water soluble and hence cannot be encapsulated with a process requiring an oleophilic phase dispersed in an aqueous phase (such as urea-formaldehyde, UF, encapsulations). However, diethylene glycol dibutyl ether (butyl diglyme) is water insoluble and thereby effective in encapsulating urea formaldehyde shells. Butyl diglyme also provides good solubility for dithiooxamide and good image development speed and good ultimate image density. It is preferred that polyglycol ethers have a water solubility of less than or equal to about 2.5 percent.

Dialkyl esters of dibasic organic acids, wherein the total number of carbon atoms in the ester is less than 17, provide excellent performance as solvents in both metal/ligand and leuco dye/acid imaging systems. A solvent of about 20 to 100 weight percent diethyl adipate with the balance, if any, being cyclohexane, provides satisfactory performance. A solvent mixture of about 10 to 80 weight percent diethyl adipate, 20 to 80 weight percent butyl diglyme and the remaining weight percent cylcohexane is a preferred solvent in that it has good solubility, good image speed, good ultimate image density and reduces contamination and residue build-up on the charging wires.

Esters of monobasic acids with the ester selected from the group consisting of benzyl, substituted benzyl or an alkyl group of 3 to 14 carbon atoms, when used in conjunction with the above solvents, especially the polyglycol ethers, also provide an excellent solvent with the advantages enumerated above.

A solvent of about 20 to 100 weight percent butyl diglyme with the balance, if any, being cyclohexane, provides satisfactory performance. However, a mixture of about 20 to 80 weight percent butyl diglyme, 5 to 60 weight percent benzyl benzoate, and the remaining weight percent being cyclohexane is a preferred solvent mixture. This mixture provides good solubility, good image speed, good ultimate image density and prevents premature residue build-up on the charging wires.

Table 1 shows the evaluation of solvents for carbonless papers of the ligand/metal type for use in photocopiers. The chemistry of the carbonless paper in these examples is based upon the reaction of a dithiooxamide color-former with a nickel(II) salt. Solvents were evaluated for odor, toxicity, solubility of dithiooxamides, imaging response of a swab of the color-former on a developer sheet, and ability of the solvent to be encapsulated. To be useful, the solvent must pass all of these tests. As shown in Table 1, compounds that perform satisfactorily in all 5 categories include the solvents of the present invention, such as butyl diglme, butyl benzoate, benzyl benzoate, and diethyl adipate.

Table 1 also demonstrates a definite decrease in the rate of image development ("image speed") with the lengthening of the alkyl chain in all 3 classes of solvents. For example, compare diethyl adipate with dibutyl adipate; ethyl caprylate with ethyl caprate; and methyl benzoate with butyl benzoate. The drop in image speed correlates with an increase in molecular weight of the solvent. Thus, a proper balance between chain length, water solubility, and imaging properties must be struck.

It should also be noted that when benzyl benzoate is used as the primary fill solvent in conjunction with cyclohexane it provides an unexpected additional advantage is noticed. When the imaging system employs metal/dithiooxamide chemistry a bluer image forms than if benzyl benzoate is not used. A bluer image is generally more pleasing than a blue/purple one. This effect appears to be general, as it is also seen with other alkyl esters of aromatic acids such as methyl benzoate, or aromatic ethers such as anisole. The amount of the shift in hue to a bluer image decreases as the length of the alcohol portion of the ester or the alkyl chain on the ether increases.

DETERMINATION OF COMPLEX COLOR

In general, the colors of the complexes were determined by preparing a solution of the color-former in the solvent to be evaluated, and then applying the solution to a substrate coated with a developer by means of an application swab. Colors were determined by means of visual evaluation and as described below. As noted in Table 2, color intensity is determined in part by the solvent employed.

One method of color measurement is to determine the color's position in color space. One color space system is the Hunter System; see F. W. Billmeyer, Jr., and M. Saltzman, *Principles of Color Technology*; John Wiley & Sons; New York, NY; Ch. 2 and 3, 1981. In this system, three mutually perpendicular axes (L, a, and b) are needed to define a color. "L" (+z axis) represents the lightness/darkness (0 is black, 100 is white); "a" (x axis) represents the amount of red or green (+a is red, −a is green); and "b" (y axis) represents the amount of yellow or blue (+b is yellow, −b is blue). By measuring a material's L, a, and b values, the color of one sample can be compared with that of other samples. Because the color of a sample is also dependent upon the color temperature of the illuminating source, the angle at which the sample is illuminated, the angle at which the illumi-

TABLE 1

Evaluation of Solvents for Use in Metal/Dithiooxamide Imaging

| SOLVENT | ODOR[1] | TOXICITY[2] | DTO[3] | RESPONSE[4] | ENCAPSULABILITY[5] |
|---|---|---|---|---|---|
| tributyl phosphate | faint | pass | excellent | good | poor |
| diethyl phthalate | faint | pass | good | poor | good |
| Experiment 2 | mild | pass | excellent | excellent | good |
| cyclohexane | mild | pass | poor | moderate | good |
| decalin | moderate | pass | poor | moderate | good |
| sec-butylbiphenyl | mild | pass | fair | very poor | good |
| 1-octanol | strong | pass | poor | good | — |
| 1-decanol | moderate | pass | poor | good | — |
| benzyl alcohol | faint | pass | good | good | poor |
| butyl ether | mild | pass | fair | excellent | poor |
| hexyl ether | mild | pass | poor | good | — |
| ethyl diglyme | faint | pass | excellent | excellent | poor |
| butyl diglyme | faint | pass | good | good | good |
| benzyl ether | faint | pass | good | very poor | — |
| butyl phenyl ether | moderate | — | fair | moderate | — |
| 1,3-dimethoxybenzene | moderate | pass | good | good | — |
| anisole | strong | pass | excellent | excellent | good |
| hexyl acetate | strong | pass | excellent | excellent | good |
| ethyl caprylate | moderate | pass | good | good | — |
| methyl benzoate | strong | pass | excellent | excellent | — |
| butyl benzoate | mild | pass | excellent | good | good |
| benzyl benzoate | faint | pass | fair | moderate | good |
| ethyl caprate | mild | pass | good | moderate | — |
| butyl butyrate | moderate | — | good | good | — |
| dimethyl adipate | faint | pass | good | moderate | — |
| diethyl adipate | faint | pass | good | good | good |
| dibutyl adipate | faint | pass | good | moderate | — |
| mixed methyl esters of dibasic acids | faint | pass | fair | moderate | good |
| diethyl malonate | faint | pass | fair | poor | — |
| diethyl succinate | faint | pass | fair | good | poor |
| diethyl glutarate | faint | pass | fair | moderate | — |
| diethyl carbonate | moderate | pass | excellent | excellent | poor |
| dibutyl carbonate | faint | pass | good | moderate | — |
| propylene carbonate | faint | pass | poor | very poor | — |
| diisopropyl carbonate | moderate | pass | good | moderate | — |
| dibutyl maleate | faint | pass | fair | poor | — |

[1]ODOR is based upon the subjective judgement of 3 persons and was ranked faint, mild, moderate, and strong. Odors other than faint or mild were rejected.

[2]TOXICITY is based upon reported LD50 values (oral, rat). Amounts below 500 mg/kg body wt are considered unacceptable.

[3]DTO represents solubility of dioctanoyloxyethyl dithiooxamide in the solvent being evaluated and was ranked poor, fair, good, excellent. Solubility above 5 wt % was rated fair and constituted the minimum basis for acceptability.

[4]RESPONSE represents the evaluation of imaging speed, ultimate image density, and quality. Tests were conducted by using a cotton swab dipped into a 1% solution of the DTO in the solvent to image a commercial CF sheet sold by 3M Co. for Blue/Purple carbonless paper. Responses were rated very poor, poor, moderate, good and excellent.

[5]ENCAPSULABILITY represents the ability of the solvent to be encapsulated in urea-formaldehyde capsules and was rated good or poor. An encapsulability of good was considered acceptable.

nation is reflectd, and the angle of the retina illuminated, these all need to be specified. Many instruments have been developed to record these values. One such instrument is the HunterLab LabScan II. This instrument is capable of automatically determining the L, a, and b values for a given sample, and was used to evaluate following examples.

Table 2 shows the evaluation of solvents for carbonless papers of the leuco dye/acid type. The chemistry of the carbonless paper in these examples is based upon the reaction of a leuco dye color-former with a phenolic developer. A low L value indicates a dark image. The a and b values indicate a darker image as their values approach zero. Table 2 illustrates that solvents such as benzyl benzoate, diethyl adipate, and butyl diglyme and mixtures with other solvents such as cyclohexane give images that are dark, black, and with a fast "speed".

The preparation of the samples for Table 2 was as follows:

A solution of 1% of N-102, a leuco dye color-former, was dissolved in a solvent to be tested (or 50/50 wt % solvent mixtures) and was swabbed onto an acid developer CF sheet. N-102 is available from Ciba Geigy, Basle, Switzerland. The developer sheet was a Mead White CF sheet. This sheet is believed to be coated with a phenolic resin. The time of color development, in seconds, until no further visual increase in color intensity was recorded. In addition, the L, a, and b values, indicating the color of the final iamge was recorded after 24 hours at room temperature using Illuminate 2° observer. This information is shown in Table 2.

TABLE 2

Evaluation of Solvents for use in Acid/Leuco Dye Imaging

| SOLVENT | L | a | b | Speed |
|---|---|---|---|---|
| Benzyl benzoate | 51.49 | −2.72 | 3.00 | 10 |
| Diethyl adipate | 54.80 | −0.69 | 2.54 | 2 |
| Butyl diglyme | 60.23 | −1.21 | 2.67 | 2 |
| Diethyl phthalate | 53.61 | −3.67 | 3.52 | 30 |
| SS290 | 61.80 | −1.97 | 3.26 | 60 |
| PXE | 55.42 | −1.56 | 3.06 | 60 |
| KMC113 | 67.76 | −2.03 | 3.42 | 300 |
| SS330 | 71.14 | −2.24 | 4.43 | 300 |
| Diethyl phthalate/cyclohexane | 58.32 | −3.54 | 3.97 | 4 |
| DEP/SS210 | 58.04 | −3.46 | 3.83 | 20 |
| Benzyl benzoate/Norpar 13 | 61.38 | −3.10 | 3.33 | 6 |
| Benzyl benzoate/Cyclohexane | 56.33 | −3.24 | 3.32 | 4 |
| Benzyl benzoate/SS210 | 58.70 | −2.30 | 2.96 | 25 |
| Diethyl adipate/Norpar 13 | 57.16 | −1.83 | 2.75 | 1 |
| Diethyl adipate/Cyclohexane | 54.20 | −1.49 | 2.97 | 1 |
| Diethyl adipate/SS210 | 52.62 | −0.60 | 2.74 | 3 |
| Butyl diglyme/Norpar 13 | 59.95 | −1.11 | 2.99 | 2 |
| Butyl diglyme/Cyclohexane | 58.66 | −0.62 | 3.10 | 1 |
| Butyl diglyme/SS210 | 62.68 | −1.26 | 2.43 | 4 |
| SS290/Norpar 13 | 61.77 | −1.92 | 2.90 | 45 |
| SS290/Cyclohexane | 62.94 | −1.81 | 3.56 | 60 |
| SS290/SS210 | 56.95 | −1.48 | 2.69 | 180 |
| PXE/Norpar 13 | 62.25 | −1.79 | 2.72 | 8 |
| PXE/Cyclohexane | 59.48 | −1.97 | 3.27 | 20 |
| PXE/SS210 | 56.36 | −1.21 | 2.96 | 120 |
| KMC113/Norpar 13 | 65.43 | −1.46 | 3.13 | 60 |
| KMC 113/Cyclohexane | 65.17 | −1.48 | 3.50 | 120 |
| KMC113/SS210 | 57.29 | −1.03 | 2.83 | 180 |
| Background | 92.84 | −2.04 | 4.81 | |

SS290 is "Sure Sol 290," (available from Koch Chemical) and is believed to be sec-butylbiphenyl.
PXE is believed to be Phenylxylylethane (available from Koch Chemical).
KMC113 is believed to be diisopropylnaphthylene (available from Kurehu Chemical).
SS330 "Sure Sol 330," is believed to be diisopropylbiphenyl.
SS210 "Sure Sol 210," is believed to be triisopropyltoluene.
Norpar 13 is an odorless kerosene (available from Exxon Corp).

EXPERIMENTAL EXAMPLES

Experiment 1

Dithiooxamide colorformers were encapsulated in urea-formaldehyde microcapsules utilizing the preferred solvent mixture of the present invention. A 26 lb basis weight paper was coated with a capsule slurry, the capsules filled with a dithiooxamide color-former, designed to give a blue/purple (B/P) image, dissolved in a solvent mixture of butyl diglyme (diethylene glycol dibutyl ether), benzyl benzoate, and cyclohexane (11.5/53.1/17.7/17.7 wt %) to provide a dry coating weight of 1.00 to 1.5 pounds per ream. The capsule slurry was composed of capsules having a 50% by volume size of 11 microns or less and a 95% by volume size of less than about 18 microns, a starch/styrene-butadiene binder, and zinc rosinate, with the ratio of capsule to binder of 2.4. The coating solution was applied using a roll coater to minimize capsule rupture during coating.

These CB sheets were printed upon using a Xerox Model 5090 copier. After 10,000, 25,000 and 50,000 and 100,000 copies the machine was found to be within operating specifications and design parameters. Upon examination of the machine, no residue was detected on the preclean dicorotron wire (the preclean dicorotron wire is a charging wire which neutralizes the static attraction of the untransferred toner on the photoreceptor surface). As noted in Table 4, when mated with a 3M CF sheet, this construction imaged faster and gave a more dense image when compared with the standard product described in Experiment 2 below.

Experiment 2

Experiment 2 was developed as a control, using a mixture of solvents previously found in carbonless paper. The paper was Carbonless Paper CB-26 B/P, available from 3M Company having capsules filled with a color-former dissolved in a solvent mixture of tributyl phosphate, diethyl phthalate, and cyclohexane (11.5/23/16/49.5 wt %). The CB sheets were printed upon using a Xerox model 5090 copier. After approximately 10,000 copies, the machine was outside of operating specifications and design parameters. Upon examination of the machine, a residue was detected on the preclean dicorotron wire. Analysis of the residue determined it resulted from oxidation of tributyl phosphate. Oxidation of the diethyl phthalate was also a minor contributor to the machine problem. As noted in Table 4, when imaged using a 3M CF, sheet this construction gave an acceptable dark, blue/purple image.

Experiment 3

Carbonless paper CB sheets were prepared and imaged using a Xerox Model 5090 copier. This time paper was 3M Carbonless Paper CB-26 B/P, prepared with color-formers dissolved in a solvent mixture similar to Experiment 2, (omitting tributyl phosphate) containing diethyl phthalate and cyclohexane (11.5/26.5/62 wt %). After approximately 10,000 and 25,000 copies, the machine was found to be within operating specification and design parameters. After approximately 50,000 copies the machine was found to be outside operating specifications and design parameters. Upon examination of the machine, a residue was detected on the preclean dicorotron wire. As noted in Table 4, when mated with a 3M CF sheet, this construction imaged significantly more slowly and gave a less dense image when compared with the standard product described in Experiment 2 above.

Experiment 4

Additional solvents were evaluated for carbonless papers to be used in photocopiers. Carbonless paper CB sheets were prepared and imaged using a Xerox Model 5090 copier. The paper was 3M Carbonless Paper CB-26 B/P, and the capsules were prepared with color-formers dissolved in a solvent mixture of diethyl adipate and cyclohexane (11.5/44.25/44.25 wt %). After approximately 10,000 copies the machine was found to be within operating specifications and design parameters. After approximately 25,000 and 50,000 copies, examination of the machine detected no residue on the preclean dicorotron wire. After approximately 100,000 copies the machine was found to be slightly outside operating specifications and design parameters. Copies remained of acceptable copy quality and no machine malfunctions were experienced. Upon examination of the machine, no residue was detected on the preclean dicorotron wire. As noted in Table 4, when mated with a 3M CF sheet, this construction afforded a similar image speed but gave a more dense image when compared with the standard product described in Experiment 2 above.

Experiment 5

Carbonless paper CB sheets were again prepared and imaged using a Xerox Model 5090 copier. The paper was 3M Carbonless Paper CB-26 B/P, prepared with color-formers dissolved in a solvent mixture of butyl diglyme and cyclohexane (11.5/55.25/33.25 wt %). After approximately 10,000 and 25,000 copies the machine was found to be operating within operating specifications and design parameters. After approximately 50,000 copies, the machine was found to be slightly outside of operating specification and design parameters. Upon examination of the machine, a residue was detected on the preclean dicorotron wire. Nevertheless, copy quality remained acceptable. After approximately 100,000 copies, no machine shutdowns were experienced and copy quality was still judged acceptable. As noted in Table 4, when mated with a 3M CF sheet, this construction imaged slightly faster and gave a more dense image when compared with the standard product described in Experiment 2 above.

Experiment 6

Carbonless paper CB sheets were again prepared and imaged using a Xerox Model 5090 copier. The paper was 3M Carbonless Paper CB-26 B/P, prepared with color-formers dissolved in a solvent mixture of benzyl benzoate and cyclohexane (11.5/59/29.5 wt %). After approximately 10,000 copies the machine was found to be outside operating specifications and design parameters. Upon examination of the machine, a residue was detected on the preclean dicorotron wire. As noted in Table 4, when mated with a 3M CF sheet, this construction imaged more slowly but gave a more dense image when compared with the standard product described in Experiment 2 above. In addition, the image was bluer than the standard product described in Experiment 2 above.

EXPERIMENT 7

Carbonless paper CB sheets were prepared and printed upon using a Xerox Model 5090 copier. The paper was again an experimental 3M Carbonless Paper CB-26 B/P, but this time the capsules were prepared with color-formers dissolved in a solvent mixture of butyl diglyme, benzyl benzoate, and cyclohexane (11.5/39.8/13.3/35.4 wt %). These CB sheets were mated with a 3M CF receptor sheet to form a 2-part reverse sequence form-set.

After approximately 10,000, 25,000, 50,000 and 100,000 sheets the machine was found to be within operating specifications and design parameters. Upon examination of the machine, no residue was detected on the preclean dicorotron wire. As noted in Table 4, this construction imaged slightly faster and gave a more dense image when compared with the standard product described in Experiment 2 above.

EXPERIMENT 8

Carbonless paper CB sheets were prepared and printed upon using a Xerox Model 5090 copier. The paper was again an experimental 3M Carbonless Paper CB-26 B/P, but this time the capsules were prepared with color-formers dissolved in a solvent mixture of butyl diglyme, diethyl adipate and cyclohexane (11.5/39.8/13.3/35.4 wt %). These CB sheets were mated with a 3M CF receptor sheet to form a 2-part reverse sequence form-set.

After approximately 10,000, 25,000 and 50,000 sheets, the machine was found to be operating within machine specifications. After approximately 100,000 sheets of the 2-part reverse sequence were run, the machine was found to be outside operating specifications and design parameters, however copy quality remained excellent. As noted in Table 4, this construction imaged slightly faster and gave a more dense ultimate image when compared with the standard product described in Experiment 2 above.

EVALUATION OF SOLVENTS USED IN DITHIOOXAMIDE/METAL IMAGING

The coated CB sheets prepared in Experiments 1-8 were evaluated using the same criteria of the swabbed materials of Table 1. Table 3 shows the results of encapsulated mixtures of solvents in Experiments 1-8 below. All performed as well or better than the present fill solvents (Experiments 2 and 3).

TABLE 3

Evaluation of Solvents for Use in Metal/Dithiooxamide Imaging After Encapsulation

| SOLVENT | ODOR[1] | TOXICITY[2] | DTO[3] | RESPONSE[4] | ENCAPSULABILITY[5] |
|---|---|---|---|---|---|
| Experiment 1 | faint | pass | excellent | excellent | good |
| Experiment 2 | faint | pass | excellent | good | good |
| Experiment 3 | faint | pass | good | poor | good |
| Experiment 4 | faint | pass | excellent | excellent | good |
| Experiment 5 | faint | pass | excellent | excellent | good |
| Experiment 6 | mild | pass | excellent | moderate | good |
| Experiment 7 | faint | pass | excellent | excellent | good |

TABLE 3-continued

Evaluation of Solvents for Use in Metal/Dithiooxamide Imaging After Encapsulation

| SOLVENT | ODOR[1] | TOXICITY[2] | DTO[3] | RESPONSE[4] | ENCAPSULABILITY[5] |
|---|---|---|---|---|---|
| Experiment 8 | faint | pass | excellent | excellent | good |

[1]ODOR is based upon the subjective judgement of 3 persons and was ranked faint, mild, moderate, and strong. Odors other than faint or mild were rejected.
[2]TOXICITY is based upon reported LD50 values (oral, rat). Amounts below 500 mg/kg body wt are considered unacceptable.
[3]DTO represents solubility of dioctanoyloxyethyl dithiooxamide in the solvent being evaluated and was ranked poor, fair, good, excellent. Solubility above 5 wt % was rated fair and constituted the minimum basis for acceptability.
[4]RESPONSE represents the evaluation of imaging speed, ultimate image density, and quality. Tests were conducted by using a cotton swab dipped into a 1% solution of the DTO in the solvent to image a commerical CF sheet sold by 3M Co. for Blue/Purple carbonless paper. Responses were rated very poor, poor, moderate, good and excellent.
[5]ENCAPSULABILITY represents the ability of the solvent to be encapsulated in urea-formaldehyde capsules and was rated good or poor. An encapsulability of good was considered acceptable.

IMAGING EVALUATION OF COATED CB SHEETS

Tests were performed on coated CB sheets to determine their characteristics and acceptability for use. These tests include evaluation of imaging speed, and ultimate image density. Imaging speed measures the time to achieve an image acceptable for viewing and is controlled by the kinetics of the imaging reaction, while ultimate image density measures the image after complete reaction and is a measure of the thermodynamics of the imaging reaction.

Imaging speed is determined by passing a CB and a CF sheet under a steel roller with an impact pressure of approximately 350 pli (pressure per linear inch) and measuring the reflectance of the resultant image four seconds after imaging. A Photovolt Model 670 Reflectance Meter with a model 610 search unit fitted with a green filter was used. This instrument is available from Seragen Diagnostics, Inc. A presently sold product such as 3M Brand Carbonless Paper has an imaging speed of 35 to 40 as shown in Table 4, Example 2. In interpreting the reflectance numbers, a high number indicates high reflectance, and a low number indicates low reflectance. Thus a white surface would have a reflectance of close to 100, and a black surface would have a refletance approaching zero. A "slower" imaging system would be expected to have a greater reflectance after 4 seconds than a faster imaging system.

Ultimate image reflectance was also measured using the Photovolt Model 670 Reflectance Meter. Subsequent to image formation the imaged sheet was heated to 102° C. for 7 seconds to fully develop the image, and the reflectance was measured. A presently sold product such as 3M B/P Brand Carbonless Paper has an ultimate image reflectance of 24 to 28 as shown in Table 4, Example 2.

Form-sets were prepared from the coated CB sheets prepared in Experiments 1-8 above by mating with a CF developer sheet. A receptor sheet of this type is available from 3M Company, under the designation of CF 17 pound white carbonless paper. The form-sets were evaluated as described above for speed and ultimate image density. Table 4 shows image speed and ultimate image density of the encapsulated solvent mixtures of Experiments 1-8. Again, the solvents of this invention had a faster image speed (lower image speed number), and/or darker ultimate image (lower ultimate image number) than the present fill solvent (Experiment 2), or the present fill solvent without tributyl phosphate (Experiment 3). Benzyl benzoate with cyclohexane (Experiment 5) gives a dark ultimate image but has a slow imaging speed. The preferred solvent mixture of butyl diglyme, benzyl benzoate, and cyclohexane (Experiment 1) provides the fastest image speed and the darkest ultimate image. It is preferred to have an image speed after four seconds of less than about 40 and an ultimate image density after heating of less than about 26. The results indicate that the solvents or mixtures of solvents of the present invention are capable of affording faster imaging speeds and better ultimate images than the previously used solvents or solvent mixtures.

TABLE 4

Speed and Ultimate Image of Encapsulated Metal/Dithiooxamide Color-Formers

| Experiment | Image Speed (4 sec) | Ultimate Image (after heating) |
|---|---|---|
| Experiment 1 | 36 | 20 |
| Experiment 2 | 40 | 26 |
| Experiment 3 | 54 | 30 |
| Experiment 4 | 40 | 21 |
| Experiment 5 | 36 | 22 |
| Experiment 6 | 46 | 22 |
| Experiment 7 | 36 | 21 |
| Experiment 8 | 38 | 22 |

Carbonless forms are often left in places where their surfaces are exposed to ambient light, such as shop areas, cars, and desks. When exposed to light, it is desirable solvents not affect the stability of the encapsulated color-former, nor must any residual solvent affect the stability of the final image on the CF sheet.

Tests were performed on coated CB sheets of Experiments 1, 2, 4-8 to determine their change in Image Speed and Ultimate Image Density after exposure to ultra-violet and fluorescent light. Imaging Speed and Ultimate Image Density were measured, as described above, on a portion of the CB sheet using a CF developer sheet. A second portion of the CB sheet was then mounted on a rotating carousel in a light box equipped with alternating GE F20T-12 DL Daylight (fluorescent) and GE F20T-BL Blacklight (ultra-violet) lamps. The light bank contained a total of 12 lamps. The CB surface was placed about 7.5 cm from the lamps with the CB side facing them. Samples were exposed for 24 hours, and then imaged using the method described above to determine the Image Speed after 4 seconds and the Ultimate Image Density. Subtraction of the initial values from the 24 hour values results in a delta value for the loss in Image Speed and Ultimate Image Density. In all cases, Imaging Speed and Ultimate Image Density decreased after 24 hours; that is, the initial numerical values were lower than the 24 hour light values. The loss in Image Speed and Ultimate Image Density was much less when solvents of the present invention were used for encapsulation than the control solvents of Experiment 2. Thus, this data indicates that solvents of the present invention afford greater light stability to the encapsulated color-former than the control solvents which are presently used in carbonless paper. The difference between the values after exposure and before exposure are reported in Table 5.

TABLE 5

Loss in Speed and Ultimate Image of Encapsulated Dithiooxamide Color-Formers After Exposure to Light

| Experiment | Loss in 4 Second Image Speed | Loss in Ultimate Image Density After Heating |
|---|---|---|
| Experiment 1 | 9.5 | 17.0 |
| Experiment 2 | 26.0 | 35.9 |
| Experiment 4 | 16.4 | 21.5 |
| Experiment 5 | 17.5 | 25.2 |
| Experiment 6 | 13.2 | 21.2 |
| Experiment 7 | 9.5 | 17.0 |
| Experiment 8 | 9.0 | 14.7 |

The effect of residual encapsulation solvent on the stability of the final imaged sheets was determined by completely imaging a CB sheet of Experiments 1, 2, 4–8 by transfer of the capsule fill to a CF sheet and complete development using the hot-shoe as described above. The ultimate image density of the developed CF sheets were measured and the CF sheets were then exposed to the ultra-violet and visible light sources described above for 24 hours. Measurement of the image density followed by subtraction of the initial values from the 24 hour values resulted in a value for the loss in image density upon light exposure. As shown in Table 6, solvents of the present invention have little if any effect on the stability of the ultimately formed metal/dithiooxamide image when exposed to strong light.

TABLE 6

Fade of Imaged Dithiooxamide Color-Formers After 24 Hour Exposure to Light

| Experiment | Change in Ultimate Image Density After Heating |
|---|---|
| Experiment 1 | 5.3 |
| Experiment 2 | 7.0 |
| Experiment 4 | 4.8 |
| Experiment 5 | 5.0 |
| Experiment 6 | 5.8 |
| Experiment 7 | 6.8 |
| Experiment 8 | 5.9 |

As will be apparent to those skilled in the art, various other modifications can be carried out for the above disclosure without departing from the spirit and scope of the invention.

We claim:

1. A carbonless copy paper having an encapsulated color-former and solvent, said color-former capable of reacting with a developer to form an image, and said solvents comprising at least one of the following:

dialkyl esters of aliphatic dibasic acids wherein the total number of carbon atoms in the ester is less than 17 and the parent alcohol contains from 1 to 4 carbon atoms, and the parent dibasic acid contains from 4 to 10 carbon atoms; and polyglycol ethers of the formula:

$$R_1O—(R_2—O)_nR_3$$

wherein $R_1$ and $R_3$ are selected from the group consisting of a phenyl, an alkyl substituted phenyl and an aliphatic hydrocarbon radical containing from 1 to 5 carbon atoms, $R_2$ is a straight chain or branched alkyl group containing from 2–4 carbon atoms, and the total number of carbon atoms of $R_1+R_3$ ranges between 4 and 10 and n is equal to 1–5, and wherein said solvent is a mixture of 10 to 80 weight percent diethylene glycol dibutyl ether, 10 to 80 weight percent diethyl adipate and the remaining weight percent comprises cyclohexane.

2. The carbonless paper of claim 1 wherein said solvent further comprises esters of monobasic aromatic acids, said parent alcohol is selected from the group consisting of benzyl, substituted benzyl and an alkyl group containing 3 to 14 carbon atoms.

3. The carbonless paper of claim 1 having an image speed after four seconds of less than about 40.

4. The carbonless paper of claim 1 having an ultimate image after heating of less than about 26.

5. A carbonless copy paper having an encapsulated color-former and solvent, said color-former capable of reacting with a developer to form an image, and said solvents comprising at least one of the following:

dialkyl esters of aliphatic dibasic acids wherein the total number of carbon atoms in the ester is less than 17 and the parent alcohol contains from 1 to 4 carbon atoms, and the parent dibasic acid contains from 4 to 10 carbon atoms; and polyglycol ethers of the formula:

$$R_1O—(R_2—O)_nR_3$$

wherein $R_1$ and $R_3$ are selected from the group consisting of a phenyl, an alkyl substituted phenyl and an aliphatic hydrocarbon radical containing from 1 to 5 carbon atoms, $R_2$ is a straight chain or branched alkyl group containing from 2–4 carbon atoms, and the total number of carbon atoms of $R_1+R_3$ ranges between 4 and 10 and n is equal to 1–5, and wherein said solvent is a mixture of 20 to 80 weight percent diethylene glycol dibutyl ether, 5 to 60 weight percent benzyl benzoate and the remaining weight percent cyclohexane.

6. A carbonless copy paper suitable for use in an electrophotographic copier, said paper having a coating of microcapsules comprising color-formers and a solvent, said solvent comprising at least one of the following:

dialkyl esters of aliphatic dibasic acids wherein the total number of carbon atoms in the ester is less than 17 and the parent alcohol contains from 1 to 4 carbon atoms, and the parent dibasic acid contains from 4 to 10 carbon atoms; and polyglycol ethers of the formula:

$$R_1O—(R_2—O)_nR_3$$

wherein $R_1$ and $R_3$ are selected from the group consisting of a phenyl, an alkyl substituted phenyl and an aliphatic hydrocarbon radical containing from 1 to 5 carbon atoms, $R_2$ is a straight chain or branched alkyl group containing from 2–4 carbon atoms, and the total number of carbon atoms of $R_1+R_3$ ranges between 4 and 10 and n is equal to 1–5, wherein said solvent further comprises cyclohexane, and wherein said solvent is a mixture of 20 to 80 weight percent diethylene glycol dibutyl ether, 10 to 80 weight percent diethyl adipate and the remaining weight percent cyclohexane.

7. The carbonless paper of claim 6 having an image speed after four seconds of less than about 40.

8. The carbonless paper of claim 6 having an ultimate image after heating of less than about 26.

9. The carbonless paper of claim 6 wherein said solvent further comprises esters of monobasic aromatic acids, said parent alcohol is selected from the group consisting of benzyl, substituted benzyl and an alkyl group containing 3 to 14 carbon atoms.

10. A carbonless copy paper suitable for use in an electrophotographic copier, said paper having a coating of microcapsules comprising color-formers and a solvent, said solvent comprising at least one of the following:

dialkyl esters of aliphatic dibasic acids wherein the total number of carbon atoms in the ester is less than 17 and the parent alcohol contains from 1 to 4 carbon atoms, and the parent dibasic acid contains from 4 to 10 carbon atoms; and polyglycol ethers of the formula:

$$R_1O—(R_2—O)_nR_3$$

wherein $R_1$ and $R_3$ are selected from the group consisting of a phenyl, an alkyl substituted phenyl and an aliphatic hydrocarbon radical containing from 1 to 5 carbon atoms, $R_2$ is a straight chain or branched alkyl group containing from 2–4 carbon atoms, and the total number of carbon atoms of $R_1+R_3$ ranges between 4 and 10 and n is equal to 1–5 and wherein said solvent is a mixture of 5 to 60 weight percent benzyl benzoate, 20 to 80 weight percent diethylene glycol dibutyl ether with the remaining weight percent cyclohexane.

11. A carbonless copy form-set containing a plurality of sheets, said plurality including at least a first substrate containing a coating of an encapsulated color-former and solvent and a second substrate containing a second coating of a developer, said first and second substrate being positioned such that said first and second are juxtaposed, said solvent comprising at least one of the following:

dialkyl esters of aliphatic dibasic acids wherein the total number of carbon atoms in the ester is less than 17 and the parent dibasic acid contains from 4 to 10 carbon atoms; and polyglycol ethers of the formula:

$$R_1O—(R_2—O)_nR_3$$

wherein $R_1$ and $R_3$ are selected from the group consisting of a phenyl, an alkyl substituted phenyl and an aliphatic hydrocarbon radical containing from 1 to 5 carbon atoms, $R_2$ is a straight chain or branched alkyl group containing from 2–4 carbon atoms, and the total number of carbon atoms of $R_1+R_3$ ranges between 4 and 10 and n is equal to 1–5, wherein said solvent further comprises cyclohexane, and wherein said solvent is a mixture of 20 to 80 weight percent diethylene glycol dibutyl ether, 10 to 80 weight percent diethyl adipate and the remaining weight percent cyclohexane.

12. The form-set of claim 11 having an image speed after four seconds of less than about 40.

13. The form-set of claim 11 having an ultimate image after heating of less than about 26.

14. The form-set of claim 11 wherein said solvent further comprises esters of monobasic aromatic acids, said ester is selected from the group consisting of benzyl, substituted benzyl and an alkyl group containing 3 to 14 carbon atoms.

15. A carbonless copy form-set containing a plurality of sheets, said plurality including at least a first substrate containing a coating of an encapsulated color-former and solvent and a second substrate containing a second coating of a developer, said first and second substrate being positioned such that said first and second are juxtaposed, said solvent comprising at least one of the following:

dialkyl esters of aliphatic dibasic acids wherein the total number of carbon atoms in the ester is less than 17 and the parent dibasic acid contains from 4 to 10 carbon atoms; and polyglycol ethers of the formula:

$$R_1O—(R_2—O)_nR_3$$

wherein $R_1$ and $R_3$ are selected from the group consisting of a phenyl, an alkyl substituted phenyl and an aliphatic hydrocarbon radical containing from 1 to 5 carbon atoms, $R_2$ is a straight chain or branched alkyl group containing from 2–4 carbon atoms, and the total number of carbon atoms of $R_1+R_3$ ranges between 4 and 10 and n is equal to 1–5, and wherein said solvent is a mixture of 20 to 80 weight percent diethylene glycol dibutyl ether, 5 to 60 weight percent benzyl benzoate with the remaining weight percent cyclohexane.

16. A carbonless copy paper having an encapsulated color-former and solvent, said color-former capable of reacting with a developer to form an image, and said solvent comprising:

polyglycol ethers of the formula:

$$R_1O—(R_2—O)_nR_3$$

wherein $R_1$ and $R_3$ are selected from the group consisting of a phenyl, an alkyl substituted phenyl and an aliphatic hydrocarbon radical containing from 1 to 5 carbon atoms, $R_2$ is a straight chain or branched alkyl group containing from 2–4 carbon atoms, and the total number of carbon atoms of $R_1+R_3$ ranges between 4 and 10 and n is equal to 1–5.

17. The carbonless paper of claim 16, wherein said solvent further comprises dialkyl esters of aliphatic dibasic acids wherein the total number of carbon atoms in the ester is less than 17 and the parent alcohol contains from 1 to 4 carbon atoms, and the parent dibasic acid contain from 4 to 10 carbon atoms.

18. The carbonless paper of claim 17 wherein said solvent is a mixture of 20 to 80 weight percent polyglycol ether, 10 to 80 weight percent dialkyl esters of aliphatic dibasic acids and the remaining weight percent cyclohexane.

19. The carbonless paper of claim 16 wherein said solvent further comprises esters of monobasic aromatic acids, wherein the alcohol portion of said ester is selected from the group consisting of benzyl, substituted benzyl and an alkyl group containing 3 to 14 carbon atoms.

20. The carbonless paper of claim 19 wherein said solvent is a mixture of 20 to 80 weight percent polyglycol ether 5 to 60 weight percent esters of monobasic aromatic acids and the remaining weight percent cyclohexane.

21. The carbonless paper of claim 16 having an image speed after four second of less than about 40.

22. The carbonless paper of claim 16 having an ultimate image after heating of less than about 26.

23. A carbonless copy paper suitable for use in an electrophotographic copier, said paper having a coating of microcapsules comprising color-formers and a solvent, said solvent comprising:

polyglycol ethers of the formula:

$$R_1O—(R_2—O)_nR_3$$

wherein $R_1$ and $R_3$ are selected from the group consisting of a phenyl, an alkyl substituted phenyl and an aliphatic hydrocarbon radical containing from 1 to 5 carbon atoms, $R_2$ is a straight chain or branched alkyl group containing from 2–4 carbon atoms, and the total number of carbon atoms of $R_1+R_3$ ranges between 4 and 10 and n is equal to 1–5.

24. The carbonless paper of claim 23 wherein said solvent further comprises dialkyl esters of aliphatic dibasic acids wherein the total number of carbon atoms in the ester is less than 17 and the parent alcohol contains from 1 to 4 carbon atoms, and the parent dibasic acid contains from 4 to 10 carbon atoms.

25. The carbonless paper of claim 24 wherein said solvent is a mixture of 20 to 80 weight percent polyglycol ether, 10 to 80 weight percent dialkyl esters of aliphatic dibasic acids and the remaining weight percent cyclohexane.

26. The carbonless paper of claim 23 wherein said solvent further comprises esters of monobasic aromatic acids, wherein the alcohol portion of said ester is selected from the group consisting of benzyl, substituted benzyl and an alkyl group containing 3 to 14 carbon atoms.

27. The carbonless paper of claim 26 wherein said solvent is a mixture of 20 to 80 weight percent polyglycol ether, 5 to 60 weight percent esters of monobasic aromatic acids and the remaining weight percent cyclohexane.

28. The carbonless paper of claim 23 having an image speed after four seconds of less than about 40.

29. The carbonless paper of claim 23 having an ultimate image after heating of less than about 26.

30. A carbonless copy form-set containing a plurality of sheets, said plurality including at least a first substrate containing a coating of an encapsulated color-former and solvent and a second substrate containing a second coating of a developer, said first and second substrate being positioned such that said first and second are juxtaposed, said solvent comprising:

polyglycol ethers of the formula:

$$R_1O—(R_2—O)_nR_3$$

wherein $R_1$ and $R_3$ are selected from the group consisting of a phenyl, an alkyl substituted phenyl and an aliphatic hydrocarbon radical containing from 1 to 5 carbon atoms, $R_2$ is a straight chain or branched alkyl group containing from 2–4 carbon atoms, and the total number of carbon atoms of $R_1+R_3$ ranges between 4 and 10 and n is equal to 1–5.

31. The carbonless copy form-set of claim 30 wherein said solvent further comprises dialkyl esters of aliphatic dibasic acids wherein the total number of carbon atoms in the ester is less than 17 and the parent alcohol contains from 1 to 4 carbon atoms, and the parent dibasic acid contains from 4 to 10 carbon atoms.

32. The carbonless copy form-set of claim 31 wherein said solvent is a mixture of 20 to 80 weight percent polyglycol ether, 10 to 80 weight percent dialkyl esters of aliphatic dibasic acids and the remaining weight percent cyclohexane.

33. The carbonless copy form-set of claim 30 wherein said solvent further comprises esters of monobasic aromatic acids, wherein the alcohol portion of said ester is selected from the group consisting of benzyl, substituted benzyl and an alkyl group containing 3 to 14 carbon atoms.

34. The carbonless copy form-set of claim 33 wherein said solvent is a mixture of 20 to 80 weight percent polyglycol ether, 5 to 60 weight percent esters of monobasic aromatic acids and the remaining weight percent cyclohexane.

35. The carbonless copy form-set of claim 30 having an image speed after four seconds of less than about 40.

36. The carbonless copy form-set of claim 30 having an ultimate image after heating of less than about 26.

37. A process for forming an electrophotographic copy comprising providing a sheet, and performing a xerographic imaging process on said sheet, wherein said sheet comprises a carbonless copy paper having an encapsulated color-former and solvent, said color-former capable of reacting with a developer to form an image, and said solvents comprising at least one of the following:

dialkyl esters of aliphatic dibasic acids wherein the total number of carbon atoms in the ester is less than 17 and the parent alcohol contains from 1 to 4 carbon atoms, an the parent dibasic acid contains from 4 to 10 carbon atoms; and polyglycol ethers of the formula:

$$R_1O—(R_2—O)_nR_3$$

wherein $R_1$ and $R_3$ are selected from the group consisting of a phenyl, an alkyl substituted phenyl and an aliphatic hydrocarbon radical containing from 1 to 5 carbon atoms, $R_2$ is a straight chain or branched alkyl group containing from 2–4 carbon atoms, and the total number of carbon atoms of $R_1+R_3$ ranges between 4 and 10 and n is equal to 1–5.

38. The process of claim 37 wherein said solvent further comprises cyclohexane.

39. The process of claim 38 wherein said solvent is a mixture of about 20 to 80 weight percent diethyl adipate and 20 to 80 weight percent cyclohexane.

40. The process of claim 38 wherein during said xerographic process, charging of said sheet is effected by a corotron or dicorotron wire.

41. The process of claim 37 wherein said solvent is a mixture of 20 to 80 weight percent diethylene glycol dibutyl ether, 10 to 80 weight percent diethyl adipate and the remaining weight percent cyclohexane.

42. The process of claim 41 wherein during said xerographic process, charging of said sheet is effected by a corotron or dicorotron wire.

43. The process of claim 37 wherein said solvent further comprises esters of monobasic aromatic acids, said parent alcohol is selected from the group consisting of benzyl, substituted benzyl and an alkyl group containing 3 to 14 carbon atoms.

44. The process of claim 37 wherein during said xerographic process, charging of said sheet is effected by a corotron or dicorotron wire.

* * * * *